US009423076B2

(12) United States Patent
Kloft et al.

(10) Patent No.: US 9,423,076 B2
(45) Date of Patent: Aug. 23, 2016

(54) PRESSURE VESSEL

(75) Inventors: Peter Kloft, Ransbach-Baumbach (DE); Horbert Baltes, Losheim (DE)

(73) Assignee: HYDAC TECHNOLOGY GMBH, Sulzbach/Saar (DE)

( * ) Notice: Subject to any disclaimer, the term of this patent is extended or adjusted under 35 U.S.C. 154(b) by 0 days.

(21) Appl. No.: 13/261,766

(22) PCT Filed: May 12, 2012

(86) PCT No.: PCT/EP2012/002100

§ 371 (c)(1),
(2), (4) Date: Oct. 28, 2013

(87) PCT Pub. No.: WO2012/167868

PCT Pub. Date: Dec. 13, 2012

(65) Prior Publication Data

US 2014/0061207 A1 Mar. 6, 2014

(30) Foreign Application Priority Data

Jun. 7, 2011 (DE) ..... 10 2011 103 424

(51) Int. Cl.

| | |
|---|---|
| ***F17C 1/08*** | (2006.01) |
| ***F15B 1/16*** | (2006.01) |
| ***F17C 1/02*** | (2006.01) |

(52) U.S. Cl.

CPC . *F17C 1/08* (2013.01); *F15B 1/165* (2013.01); *F17C 1/02* (2013.01); *F15B 2201/205* (2013.01); *F15B 2201/3152* (2013.01); *F15B 2201/4053* (2013.01); *F15B 2201/4056* (2013.01); *F15B 2201/615* (2013.01); *F17C 2201/018* (2013.01); *F17C 2205/0397* (2013.01); *F17C 2270/0554* (2013.01)

(58) Field of Classification Search

USPC ..... 220/723, 592, 586

See application file for complete search history.

(56) References Cited

U.S. PATENT DOCUMENTS

| | | | | |
|---|---|---|---|---|
| 3,232,318 | A * | 2/1966 | Mercier | 138/30 |
| 3,537,481 | A * | 11/1970 | Mercier | 138/30 |
| 2008/0201932 | A1 * | 8/2008 | Schlag | 29/452 |

FOREIGN PATENT DOCUMENTS

| | | | |
|---|---|---|---|
| CN | 2009 85 916 | Y | 12/2007 |
| DE | 30 30 616 | A1 | 3/1981 |
| DE | 40 35 785 | C2 | 5/1982 |
| DE | 10 2006 004 120 | A1 | 7/2007 |
| JP | 11 013995 | A | 1/1999 |

* cited by examiner

*Primary Examiner* — Jeffrey Allen

(74) *Attorney, Agent, or Firm* — Wenderoth, Lind & Ponack, L.L.P.

(57) ABSTRACT

A pressure vessel for receiving at least one fluid medium has a first shell (1) and a second shell (3) at least partially encompassing the first shell (1). The first shell (1) has, at least at one of its ends, a collar portion (5) having a securing element (15) that forms an opening (13) for supplying and discharging the medium. A support element (19) in the form of a split ring surrounds the opening (13), is provided inside the container and has a contact surface (39) adapted to the curved shape of the first shell (1) inner side attached to the collar portion (5). The contact surface is able to be pressed onto the first shell inner side attached to the collar portion (5). The contact surface is able to be pressed onto the first shell (1) using a pressing device (43, 45).

11 Claims, 2 Drawing Sheets

PRESSURE VESSEL

FIELD OF THE INVENTION

The invention relates to a pressure vessel, for example in the form of a hydraulic accumulator, for receiving at least one fluid medium, having a first shell and a second shell at least partially encompassing the first shell. The first shell has a collar section at least at its one end having a securing element forming an opening for the supply and discharge of a medium.

BACKGROUND OF THE INVENTION

WO 2007/085276 A1 discloses a generic composite pressure vessel for the storage of media under pressure having a liner made of plastic as an inner or first shell. A winding made of fiber composite material reinforcing the liner is provided as a second shell. A securing element enclosed by the collar section forming the media opening interacts with a connection fitting and includes a valve arrangement, if applicable.

To achieve a highly reliable operating performance, in particular in the case of long-term operation, vessels of this kind must ensure that the forces acting on the vessel by the securing element during operation can be safely accommodated. In particular in the case of composite vessels, any relative movements that may occur between the plastic shells must be eliminated to avoid damaging delaminating processes between the sensitive plastic materials.

SUMMARY OF THE INVENTION

An object of the present invention is to provide an improved pressure vessel characterized by a high structural strength, especially in the region of the collar section and a securing element allocated to the connecting devices.

This object is basically achieved according to the invention by a pressure vessel having a support element provided inside the vessel. The support element has a contact surface adapted to the curved shape of the inside of the first shell connected to the collar section. The contact surface can be pressed onto the first shell using a pressing device. Not only is the risk of the relative movement thereby avoided, but the form closure between the support element and the shells provides protection against deformation, and therefore, against a deterioration of the seal.

Plastic can then be used in the invention in an advantageous manner as a material for one shell, or preferably for both shells.

Due to the fact that the support element is designed in the form of a split ring, this support element can advantageously be made out of a rigid material, preferably metal, although the outer diameter thereof may be substantially greater than the vessel opening.

Particularly advantageously, the support element is fixed on the securing element such that the pressing device transfers the force for pressing that support element onto the first shell to the support element.

Particularly advantageously the securing element has the form of a pipe socket that extends from the interior of the vessel. The pipe socket has a flange at the inner end forming a shoulder surface on which the support element is secured against axial movement toward the interior of the vessel.

The pressing device allocated for the support element particularly advantageously is to be implemented such that the pipe socket has an external thread for a nut. By of the nut, a tensile force can be generated on the pipe socket to press the support element onto the first shell.

In especially preferred embodiments, the support element has an inner end face defining a radial plane. The end surface, together with the contact surface, forms an angular peripheral edge on the radially outer end. A retaining ring preferably and advantageously projects axially into the interior of the vessel from the end face of the support element. The retaining ring has a radially deflected edge for interlocking with a ring disk made of an elastomer material seated on the inner edge of the pipe socket. The radially outer edge of that ring disk forms a continuation of the curved contact surface of the support element when attached to the inside of the first shell. A gasket is then formed, which seals the pipe socket, including the support element seated thereon, from the interior of the vessel.

In especially advantageous embodiments, the nut allocated to the external thread of the pipe socket has an axially projecting flange. That flange engages in an annular gap between the pipe socket and the collar section of the first shell. Between that collar section and the support element a seal arrangement is disposed. An additional seal is thereby formed in a sealing gap between the pipe socket and the collar section, precisely defined by the flange of the nut.

In an especially advantageous manner, the second, outer shell terminates at a distance from the collar section of the first shell. That the collar section is enclosed by a stiffening ring, preferably formed as a metal ring, in the space that is formed. As a result, the opening area, i.e. the connection area of the vessel, exhibits an especially high rigidity.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
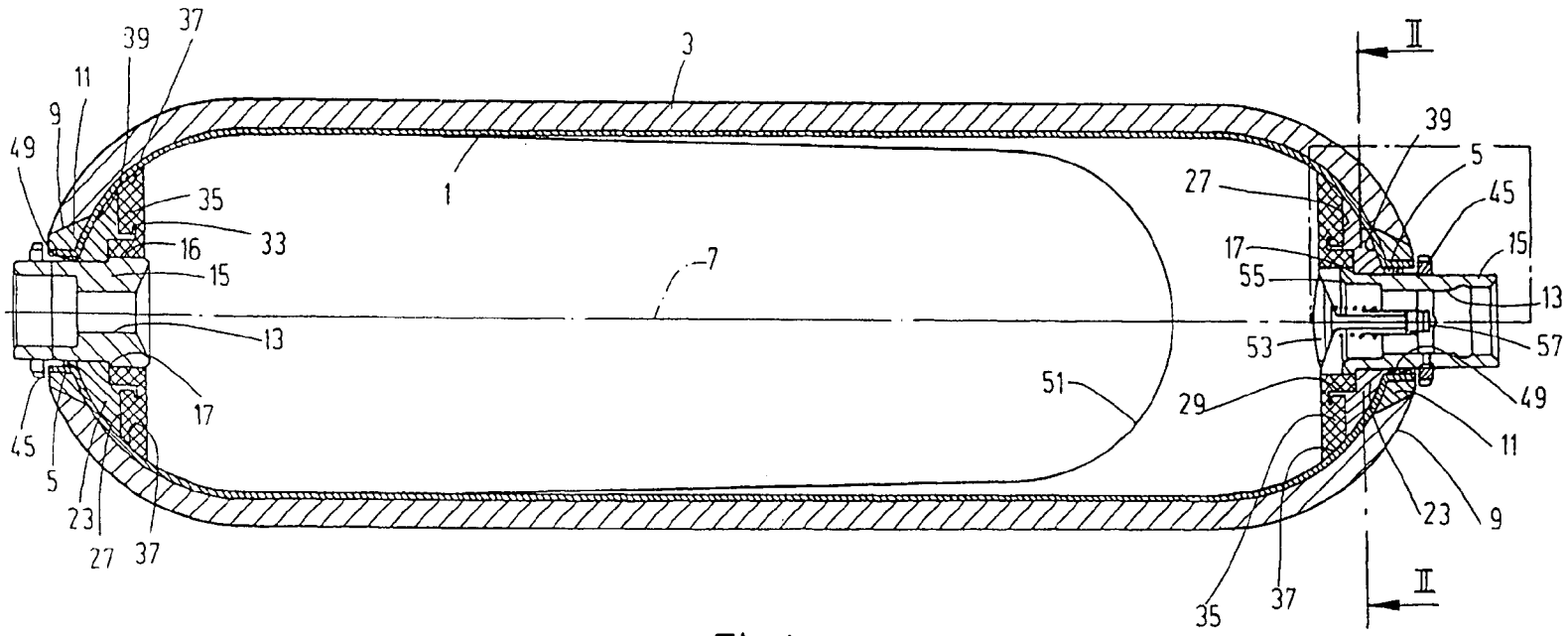
FIG. 1 is a side elevational view in section of a pressure vessel according to an exemplary embodiment of the invention.

The following description of the invention is based on a composite pressure vessel in the form of a bladder accumulator. The accumulator comprises a first plastic shell 1 and a second plastic shell 3 that at least partially encompasses the first plastic shell 1. One or both shells may also be manufactured out of a metallic material such as aluminum. In technical terminology, the first plastic shell 1 provided in the present example is also referred to as a plastic core vessel or as a liner. It is preferably made of polyamide or polyethylene and formed by a blow molding process or rotational molding. Because continuous manufacturing processes are the conventional, this forming process will not be addressed in greater detail here.

The outer circumference of the liner 1 is reinforced by fiber wrapping on the outside by a second plastic shell 3. For example, the reinforcing winding is formed of a fiber reinforcement such as carbon, aramid, glass-, boron, or $AL_2O_3$ fibers or mixtures thereof, which reinforcements are referred to as hybrid yarns, which yarns are embedded in a basic matrix of thermoset materials such as epoxy or phenolic resins, or in thermoplastics such as PA12, PA6, PP etc. The fiber composite material that forms the supportive casing contains fiber strands that are embedded in synthetic resin and that cross one another such that they essentially extend in longitudinal and circumferential directions. The fiber composite material that forms the supportive casing may additionally or alternatively include other intersecting fiber strands, which fiber strands may be angled in the longitudinal or circumferential direction. In an advantageous further embodiment, the fiber strands may be disposed so that they are angled mirror inverted to one another along the longitudinal axis of the plastic core vessel.

The longitudinal and circumferential forces can thus be absorbed in an optimal manner by the pressure vessel. Moreover, the possibilities of setting the ratio of the opening cross section of a front opening with respect to the inner diameter of the plastic core vessel to large values of at least 30%, preferably of at least 50%, are improved without resulting functional impairments. The first plastic shell 1 forms a cylindrical collar section 5 at each or its opposite ends. In an embodiment not shown here, it is also possible to close the end of the first plastic shell 1 and to provide only one collar section 5. The pressure vessel is formed essentially rotationally symmetrical and extends along its longitudinal axis 7. The second plastic shell 3 forms a tapered region 9 with a wedge-shaped cross section at its free end. Tapered region 9 is supported on a stiffening ring 11 encompassing the respective collar section 5. The stiffening ring preferably is manufactured out of metal or a fiber composite material having high-modulus fibers.

To form a respective vessel opening 13 as a securing element for connection fittings and the like (not shown), a pipe socket 15 is provided at both ends of the vessel. Pipe socket 15 extends out of the interior of the vessel through the collar section 5 to the exterior. In the present example, the pipe sockets 15 have the same outer diameter clamping down on the respective collar section 5, however they differ in axial length and in the design of the inner vessel opening 13, which has a stepped section having a reduced inner diameter in the left-hand pipe socket in FIG. 1. In the embodiment of the pressure vessel in the form of a hydraulic accumulator, or more precisely, a bladder accumulator, shown here, the pipe socket 15 located on the left side in FIG. 1 acts as a connection for a working gas for a gas-conveying working chamber, which is separated from a working chamber for a hydraulic medium by a bladder accumulator 51 forming an elastomer separating diaphragm. This hydraulic medium-carrying working chamber connects to the pipe socket 15 located on the right side in FIG. 1. Having the form of a so-called SAE flange, this connection forms both the connection for the relevant hydraulic medium as well as the valve housing for a valve arrangement, as is known in such devices from the prior art (see, e.g., DE 10 2006 004 120 A1). This valve arrangement has a spring-loaded poppet valve. The valve disk 53 of the poppet valve is located on a valve stem 57 and works together with a closing surface 55 on the pipe socket 15.

Figure 3:
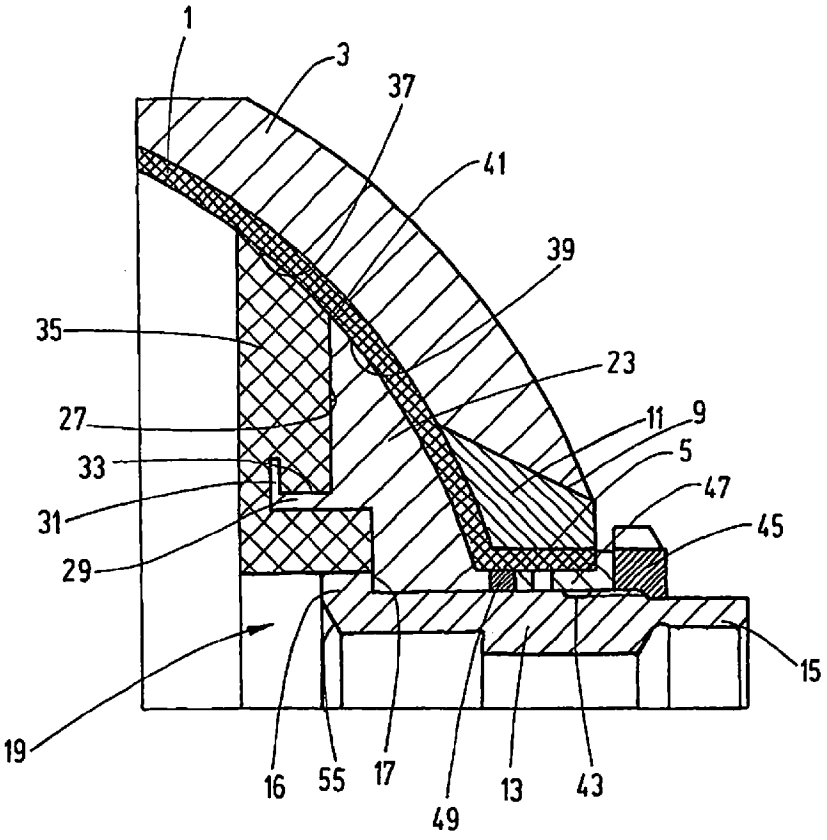
FIG. 3 is an enlarged partial side elevational view in section of only the region designated as III in FIG. 1, wherein, for the sake of clarity, the valve arrangement has been omitted.
Figure 2:
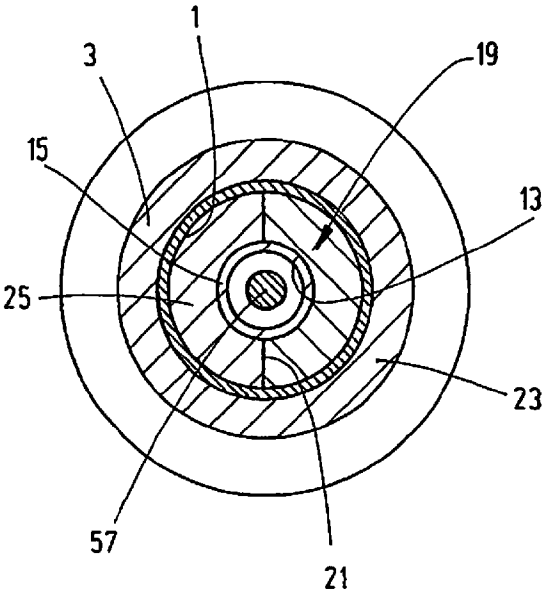
FIG. 2 is an end view in section taken along line II-II of FIG. 1, which view has been slightly enlarged as compared to FIG. 1.

As can most clearly be seen in FIG. 3, both pipe sockets 15 have a flange 16 on their inner end, which flange forms a shoulder surface 17. This shoulder surface 17 forms a stop surface for a support element 19 disposed on the pipe socket 15. The support element is formed by a metal ring divided into two ring halves 23 and 25 having a flat separation plane; see FIG. 2. The one ring half 23 of the support element 19 is visible in each of the sectional views in FIGS. 1 and 3. As can most clearly be seen in FIG. 3, a retaining ring 29 extends from the inner end face 27 of the support element 19 axially into the interior of the vessel. This retaining ring 19 has a bent down edge 31. This edge 31 forms a retaining hook interlocking in an annular slot opening 33 in a ring disk 35 made of an elastomer material to secure this ring disk by locking to the support element 19. The ring disk 35 is seated on the inner end of the pipe socket 15, or more precisely stated, on this flange 16. The radial outer edge 37 of the elastomer ring disk 35 abuts the inside of the first shell 1. Outer edge 37 connects to the curved contact surface 39, with which the support element 19 abuts the inside of the first shell 1. This contact surface 39, which is adapted to the convex curved shape of the inside of the first shell 1 adjoining the collar section 5, extends from the collar section 5 to the angular peripheral edge 41 (FIG. 3) of the ring disk 35.

The pressing device adapts the support element 19 with its contact surface 39 to the first shell 1 and generates a tensile force in the pipe socket 15 from the interior of the vessel outward. This force is transferred to the support element 19 by the shoulder surface 17 on the flange 16 of the pipe socket. For this purpose, the pipe socket 15 has an external thread 43 (FIG. 3) for a nut 45. This nut is supported on the collar section 5, which is reinforced by the stiffening ring 11 to generate the outwardly acting screwing force, and has a flange 47 meshing in an annular gap between the pipe socket 15 and the collar section 5. A seal arrangement 49 is disposed in the annular gap defined by this flange 47. The screwing force generated by the nut 45 is transferred to the support element 15 by the flange 16 and the shoulder surface 17 of the pipe socket 15 and presses the contact surface 39 thereof to the inside of the first shell 1, with the bladder accumulator abutting the inside thereof. Operating loads acting on the pipe socket 15 are extensively discharged into the composite material of the shells 1 and 3 by the support element 19 and the contact surface 39 thereof. Contact surface 39 forms a part of the spherical surface, so that deformations and/or relative movements of the shells 1, 3 are reliably prevented. At the same time, the edge 37 of the elastomer ring disk 35 abutting the inside of the shell 1, together with the seal arrangement 49 on the pipe socket 15, forms a sealing system ensuring the pressure tightness of the vessel in long-term operation as well.

While one embodiment has been chosen to illustrate the invention, it will be understood by those skilled in the art that various changes and modifications can be made therein without departing from the scope of the invention as defined in the appended claims.

What is claimed is:

1. A pressure vessel for receiving at least one fluid medium, comprising:

a first shell having a collar section at least at a first end thereof, said collar section forming an opening, said opening receiving a pipe socket, said pipe socket forming a securing element for supply and discharge of a medium, said collar section being enclosed by a stiffening ring;

a second shell partially encompassing said first shell and terminating at a second shell end at a distance from said collar section of said first shell, said stiffening ring being in a space between said second shell end and said collar section;

a support element being a split ring surrounding said opening and located inside said first and second shells, said support element having a curved contact surface conforming to a curved inside surface of said first shell connected to said collar section and having an inner end surface defining a radial plane, said end surface and said contact surface meeting to form an acute angle therebetween at a peripheral edge on a radially outer end of said support element;

a pressing device pressing said contact surface onto said first shell; and a retaining ring projecting axially into an interior of said first and second shells from an inner end surface of said support element, said retaining ring having a bent edge forming a retaining hook interlocking an annular slot opening in a ring disk of elastomeric material seated on an inner edge of said pipe socket, a radially outer edge of said ring disk forming a continuation of said curved contact surface of said support element attached to said inside surface of said first shell.

2. A pressure vessel according to claim 1 wherein said first and second shells form a housing of a hydraulic accumulator with a member separating first and second chambers inside said first shell.

3. A pressure vessel according to claim 1 wherein at least one of said first and second shells is made of plastic material.

4. A pressure vessel according to claim 1 wherein said support element comprises a split metal ring.

5. A pressure vessel according to claim 1 wherein said support element is fixed to said securing element to transfer forces of said pressing device pressing said support element onto said first shell.

6. A pressure vessel according to claim 1 wherein said pipe socket extends from an interior of said first shell, said pipe socket having a flange at an inner end thereof forming a shoulder surface abutting said support element securing said support element against axial movement toward said interior of said first shell.

7. A pressure vessel according to claim 6 wherein said pipe socket comprises an external thread threadedly engaged with a nut forming said pressing device generating a tensile force on said pipe socket pressing said support element onto said first shell.

8. A pressure vessel according to claim 1 wherein said ring disk is seated on said inner end surface of said support element, a radially outer edge of said retaining ring forming a continuation of said curved contact surface of said support element attached to said inside surface of said first shell.

9. A pressure vessel according to claim 7 wherein said nut comprises an axially projecting flange engaged in an annular gap between said pipe socket and said collar section of said first shell; and a seal is between said axially projecting flange and said pipe socket.

10. A pressure vessel according to claim 1 wherein said stiffening ring is a metal ring.

11. A pressure vessel according to claim 1 wherein said contact surface is curved and conforms to said curved inside surface of said first end continuously from said collar section of said first shell to said end surface of said support element.

* * * * *